US010221808B2

(12) United States Patent
Miller

(10) Patent No.: US 10,221,808 B2
(45) Date of Patent: Mar. 5, 2019

(54) STIRLING ENGINE AND METHODS OF OPERATIONS AND USE

(71) Applicant: Solar Miller, Sparks, NV (US)

(72) Inventor: Solar Miller, Sparks, NV (US)

( * ) Notice: Subject to any disclaimer, the term of this patent is extended or adjusted under 35 U.S.C. 154(b) by 327 days.

(21) Appl. No.: 14/755,930

(22) Filed: Jun. 30, 2015

(65) Prior Publication Data

US 2016/0160795 A1 Jun. 9, 2016

Related U.S. Application Data

(63) Continuation-in-part of application No. 13/411,630, filed on May 2, 2012.

(51) Int. Cl.
*F02G 1/044* (2006.01)

(52) U.S. Cl.
CPC ..... *F02G 1/044* (2013.01); *F02G 2244/50* (2013.01); *F02G 2270/42* (2013.01)

(58) Field of Classification Search
CPC ..... F02G 1/0435; F21B 4/41; F01B 29/10
See application file for complete search history.

(56) References Cited

U.S. PATENT DOCUMENTS 3,488,945 A 1/1970 Kelly
4,009,573 A * 3/1977 Satz ..... F02G 1/043 418/13
4,072,010 A * 2/1978 Schuman ..... F02G 1/0435 417/207
4,199,945 A * 4/1980 Finkelstein ..... F02G 1/0435 60/520
4,307,211 A 12/1981 Ito et al.
4,429,530 A * 2/1984 Beale ..... F02G 1/0435 60/520
4,852,356 A * 8/1989 Unger ..... F02G 1/0445 62/6
4,977,742 A 12/1990 Meijer
5,010,734 A 4/1991 Ho
(Continued)

FOREIGN PATENT DOCUMENTS

JP 2004124896 A * 4/2004

OTHER PUBLICATIONS

English Translation JP 2004124896 A.*
100 HP Stirling Engine.*
Miller, Solar, The 100 horsepower 80 pound Sterling engine for a reasonable price???, available at stirling.nevadacan.com, Apr. 25, 2011 (12 pp.).
(Continued)

*Primary Examiner* — Mark A Laurenzi
*Assistant Examiner* — Shafiq Mian
(74) *Attorney, Agent, or Firm* — Holland & Hart, LLC

(57) ABSTRACT

A double acting, miller cycle, reciprocating piston with dual rotary displacer, stirling engine is provided. Configurable as a heat pump, a heat engine, or as a combination with one side driving the other, the engine is completely closed, sealed and pressurized with the piston ring as the only internal seal. A miller cycle is created by allowing transfer of the working fluid (typically hydrogen gas) past the piston to balance working fluid pressure only at the extremes of the piston stroke. Two coordinated rotating displacers service opposite sides of one piston. Each displacer manages heat flow, according it its length and shape, through one side of the length of its encasing tube into and out of the working fluid through the other side of the length of its encasing tube. The dead space between the piston and the displacer holds regenerator material.

21 Claims, 16 Drawing Sheets

(56) References Cited

U.S. PATENT DOCUMENTS

| | | | | |
|---|---|---|---|---|
| 5,199,722 | A | 4/1993 | Wada et al. | |
| 5,456,076 | A * | 10/1995 | Zornes | F01B 1/12 60/525 |
| 5,711,232 | A | 1/1998 | Yamaguro et al. | |
| 6,662,775 | B2 | 12/2003 | Hauser | |
| 6,834,636 | B2 | 12/2004 | Thomas et al. | |
| 7,891,184 | B2 * | 2/2011 | Gimsa | F02G 1/044 60/516 |
| 8,640,454 | B1 * | 2/2014 | Nord | F02G 1/05 60/520 |
| 2001/0042373 | A1 * | 11/2001 | Bliesner | F02G 1/043 60/517 |
| 2003/0000210 | A1 * | 1/2003 | Gross | F02G 1/057 60/517 |
| 2003/0074897 | A1 * | 4/2003 | Rollston | F01B 3/0023 60/517 |
| 2010/0162697 | A1 * | 7/2010 | Fleck | F02G 1/043 60/519 |
| 2012/0318355 | A1 * | 12/2012 | Boyle | F28D 15/0233 136/259 |
| 2013/0192221 | A1 * | 8/2013 | Osborne | F01K 25/00 60/518 |

OTHER PUBLICATIONS

U.S. Appl. No. 14/755,930, filed Jun. 30, 2015, Solar Miller, Stirling Engine and Methods of Operation and Use.

US-2014/0238012, Aug 28, 2014, U.S. Appl. No. 13/411,630, filed May 2, 2012, Solar Miller, Stirling Engine.

* cited by examiner

STIRLING ENGINE AND METHODS OF OPERATIONS AND USE

CROSS-REFERENCE TO RELATED APPLICATIONS

This is a continuation-in part of U.S. patent application Ser. No. 13/411,630, titled "Stirling Engine," filed 2 May 2012, published as U.S. Pat. App. Pub. No. 2014/0238012, the entire contents of which application are incorporated herein by reference. It is to be understood, however, that in the event of any inconsistency between this specification and any information incorporated by reference in this specification, this specification shall govern.

BACKGROUND

The concept of mechanically manipulating the ideal gas laws to convert heat into motion or vice-versa was first patented by Robert Stirling in 1817. Since that time several designs, most utilizing multiple pistons, have emerged including some designs utilizing pressure waves in lieu of a displacer with only a single piston.

The basic Stirling engine includes a trapped gas that is heated or cooled which then expands or contracts (according to the ideal gas laws) which pushes or pulls on a piston which then drives a crankshaft. The crankshaft is typically coupled to a flywheel and an output shaft. The output shaft delivers usable mechanical force relative to the initial temperature differential and amount of heat transferred.

Current commercial designs utilize a piston style displacer to move the working gas from a heating chamber to a cooling chamber and back. Common designs use multiple internal seals and two or more pistons. Current designs are complex and difficult to manufacture making them relatively high cost. The greater efficiency, reliability, lifespan, cleanliness, and flexibility that Stirling engines demonstrate compared to internal combustion engines has previously been sacrificed in favor of the faster start up, control response, greater power density, and ease of manufacture of competing engines. However, the inherent advantages of the Stirling engine allows it to compete successfully in various specialty niches of the engine market, such as satellite power production, waste heat recovery, cryogenics, solar power conversion, space craft, and submarines, where faster start up, control response, greater power density, and ease of manufacture are not the critical criteria in engine selection.

The Stirling engine has many advantages such that it could displace internal combustion engines in many applications if a few of the Stirling engine's drawbacks could be addressed. For example the Stirling engine has fewer moving parts, no need for expensive sound deadening or exhaust gas treatment, nor complex ignition, timing, and fuel handling requirements. Furthermore, the Stirling engine benefits from a large menu of energy sources and fuels to choose from and the use of non-polluting gasses when used in refrigeration.

Accordingly, there is a need for a Stirling engine with lower cost, and higher power density. Such an improved Stirling engine could become the mainstream choice in such applications as hybrid automobiles, aircraft, and boats, as well as electric generators, refrigerators and water heaters. In other words, applications in which costs, simplicity and power density are the primary consideration and where start up speed and control response are ancillary considerations.

DRAWINGS

The accompanying drawings, which are incorporated in and constitute a part of this specification, illustrate embodiments of an improved Stirling engine and together with the description, serve to explain the principles and operation thereof.

DETAILED DESCRIPTION

Figure 1:
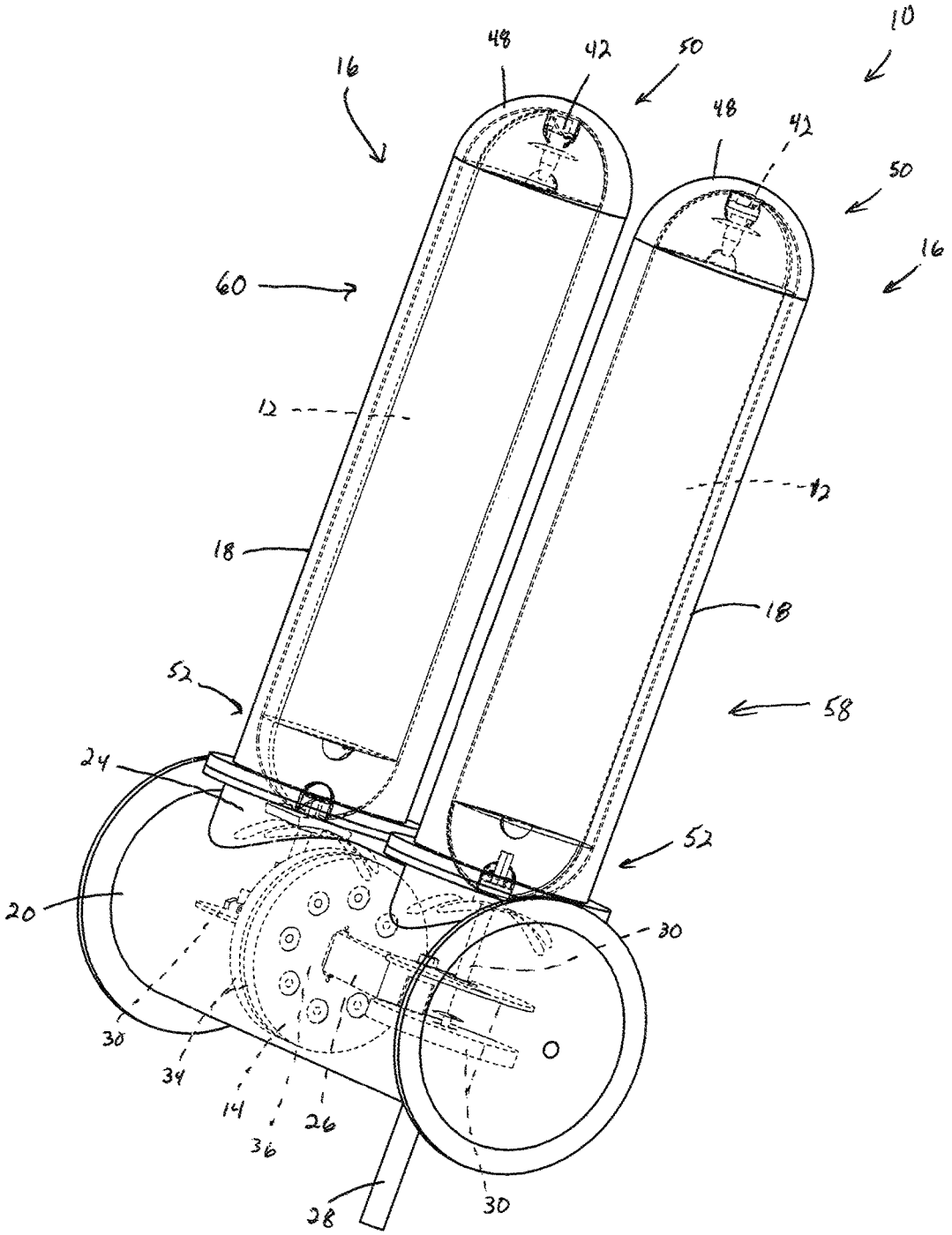
FIG. 1 is a hidden line perspective side view of a Stirling engine according to an exemplary embodiment with the piston at the end of a power stroke.
Figure 2:
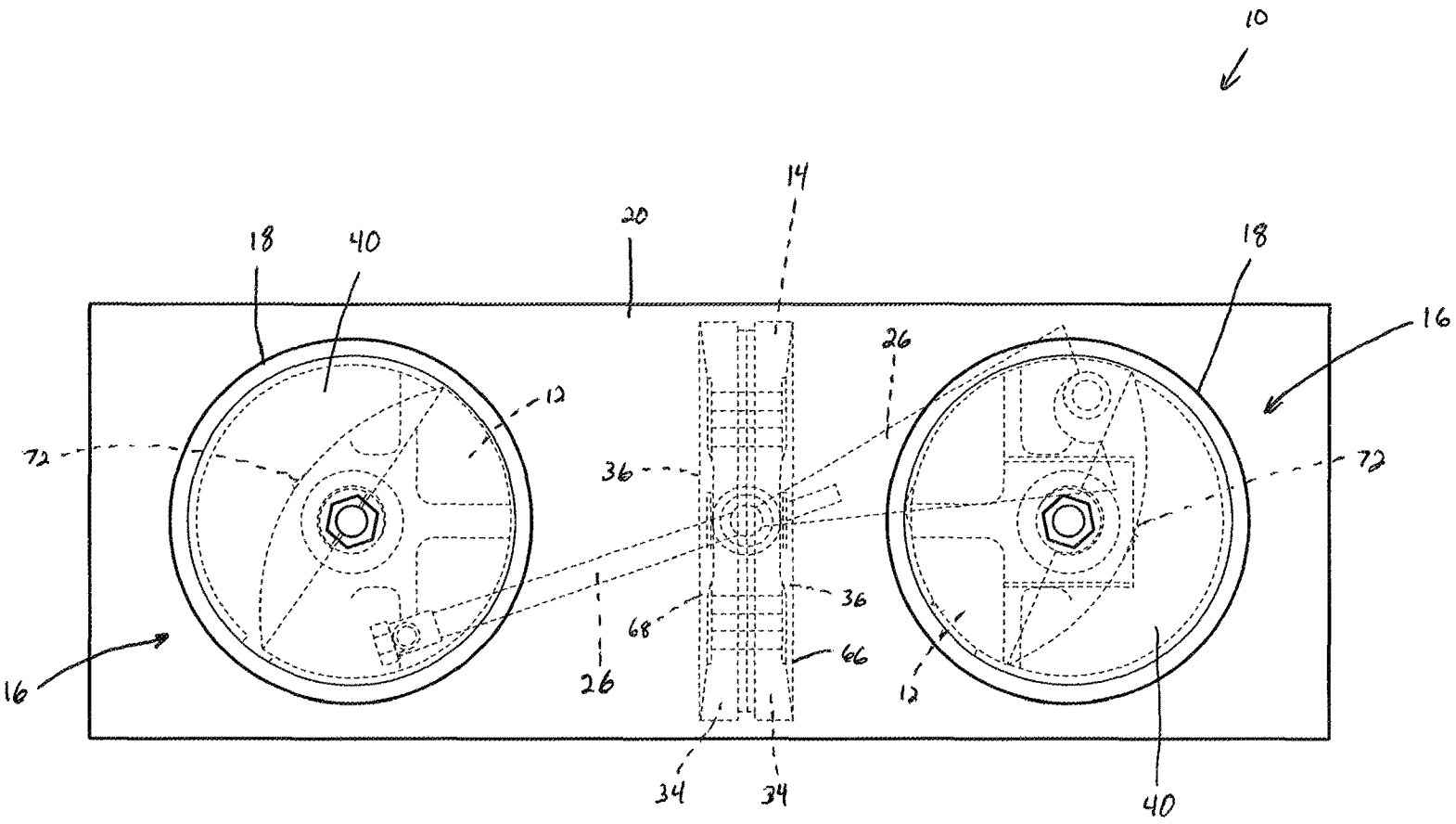
FIG. 2 is a hidden line end view of the Stirling engine shown in FIG. 1 with the piston approximately half-way through a power stroke.
Figure 3:
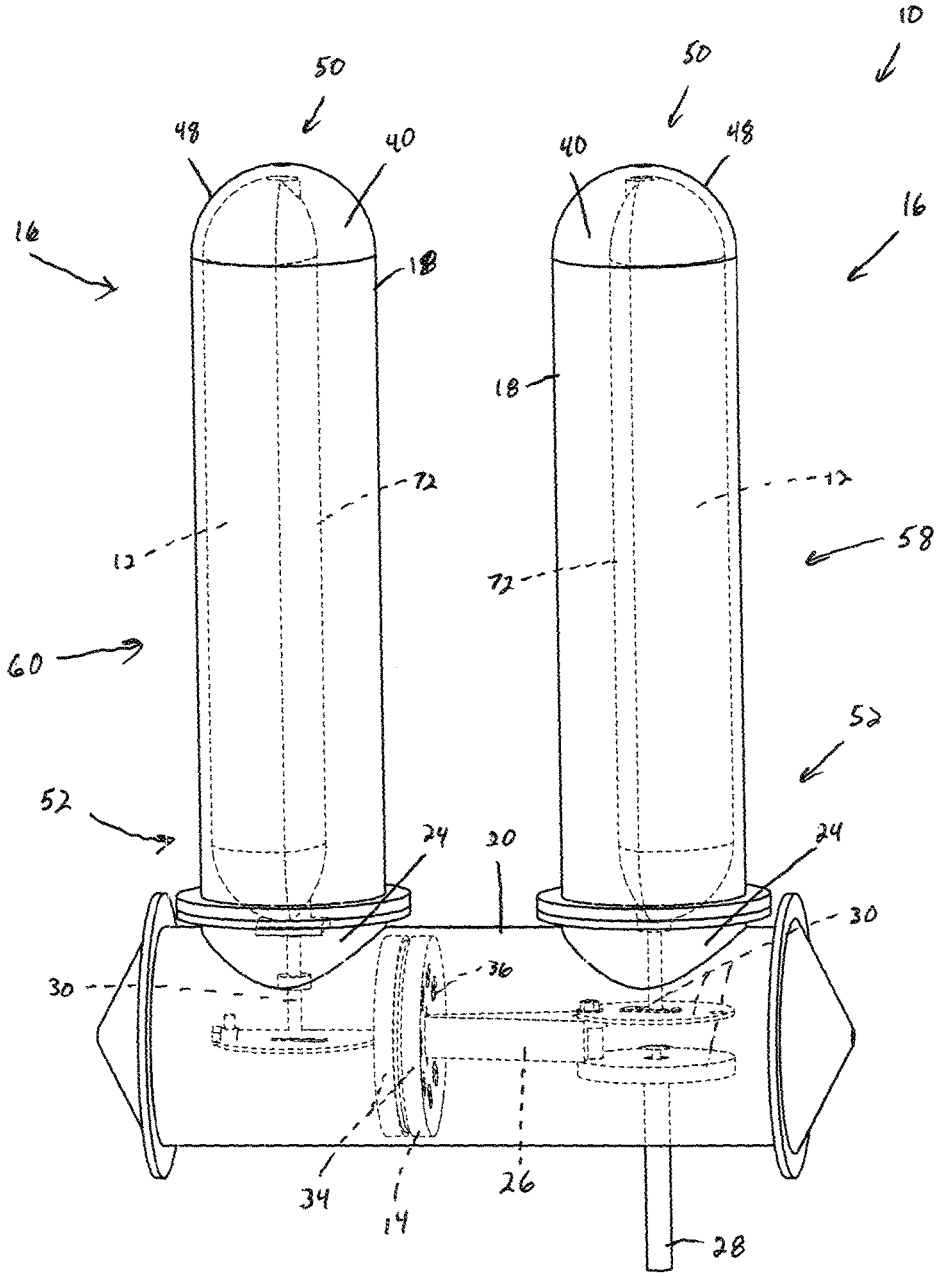
FIGS. 3 and 9 are hidden line perspective top views of the Stirling engine shown in FIG. 1.
Figure 4:
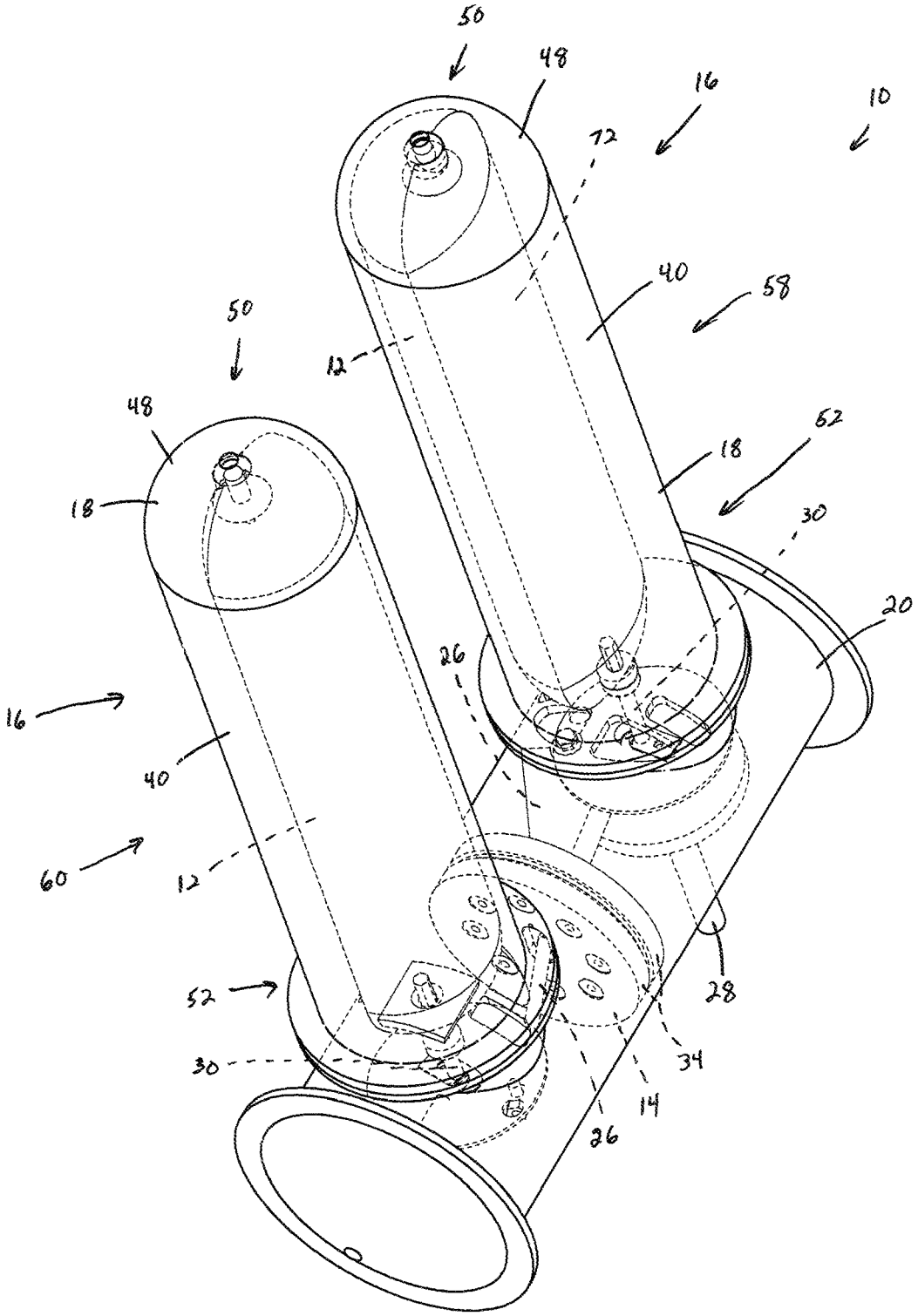
FIGS. 4-5 are hidden line perspective end views of the Stirling engine shown in FIG. 2.
Figure 7:
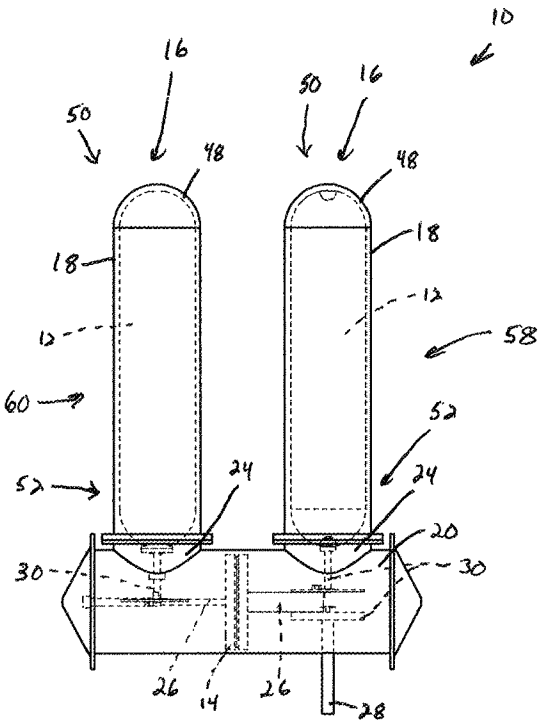
FIG. 7 is a hidden line top view of the Stirling engine shown in FIG. 2.
Figure 6:
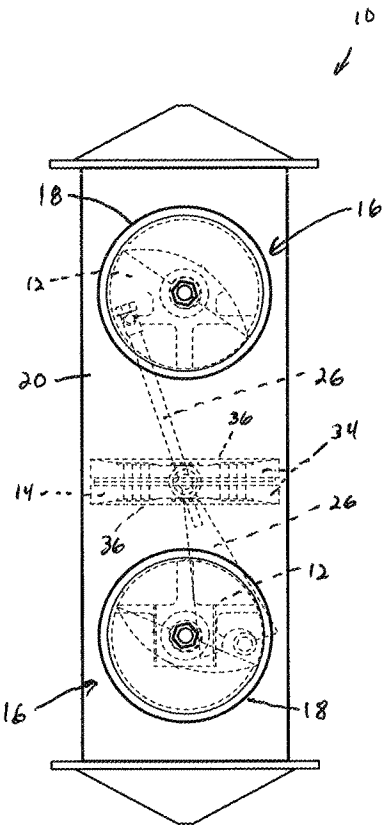
FIG. 6 is a hidden line end view of the Stirling engine shown in FIG. 2.
Figure 5:
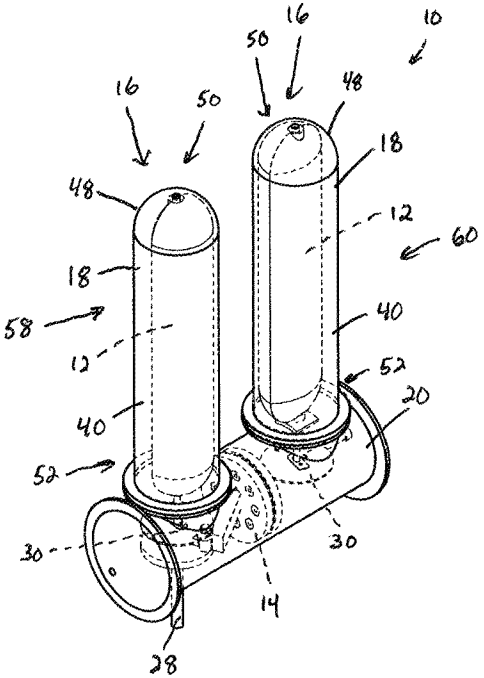
Figure 10:
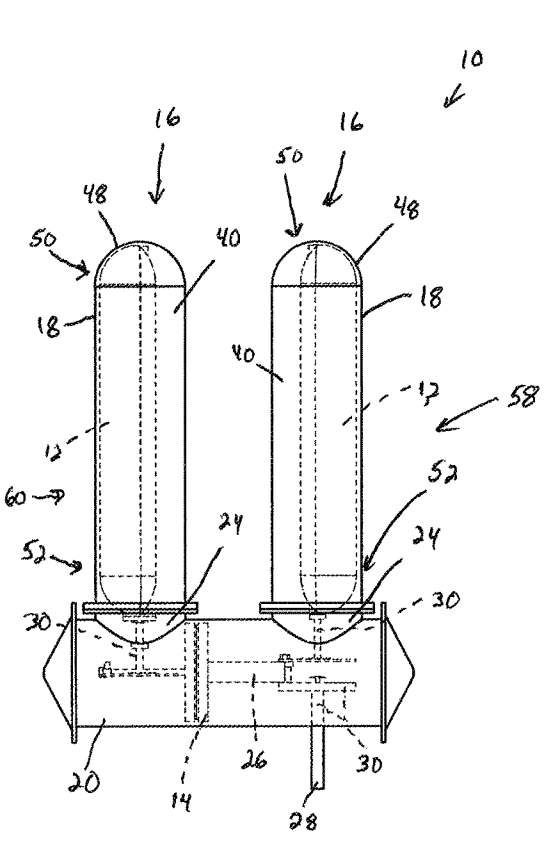
FIG. 10 is a hidden line top view of the Stirling engine shown in FIG. 1.
Figure 9:
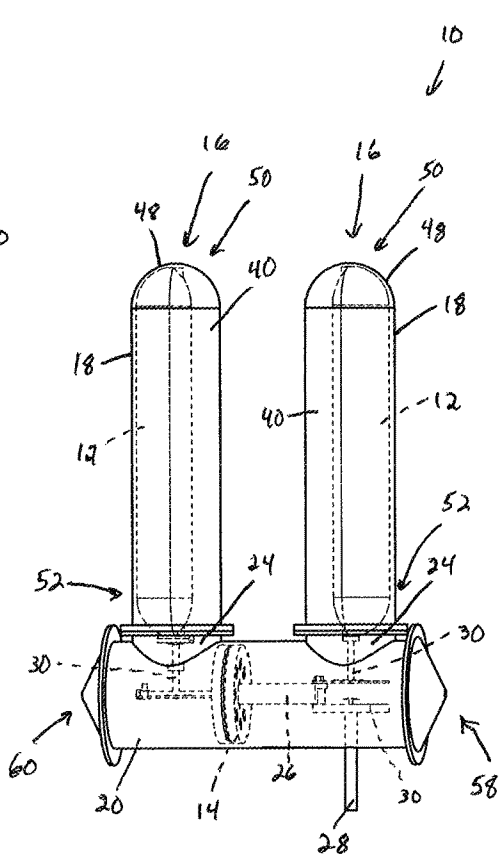
Figure 8:
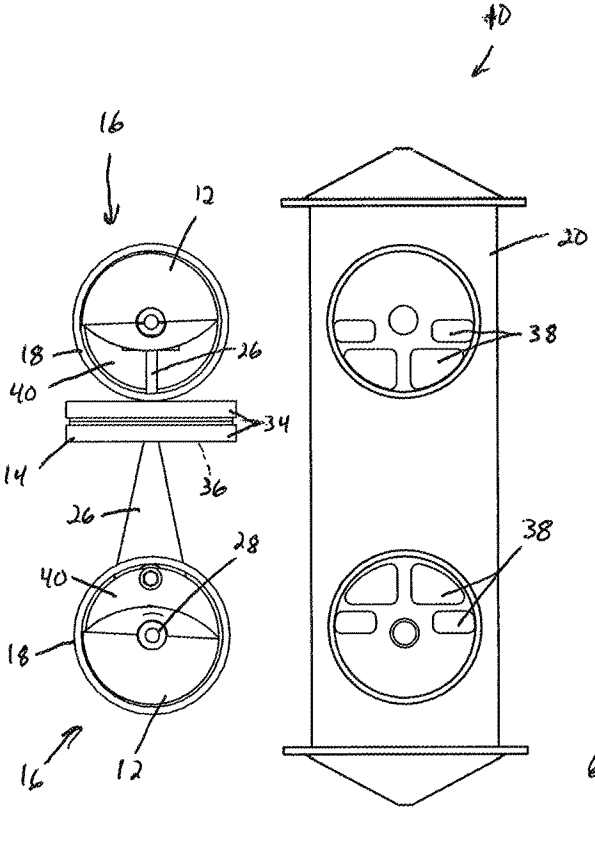
FIG. 8 is a partially exploded end view of the Stirling engine shown in FIG. 1.
Figure 11:
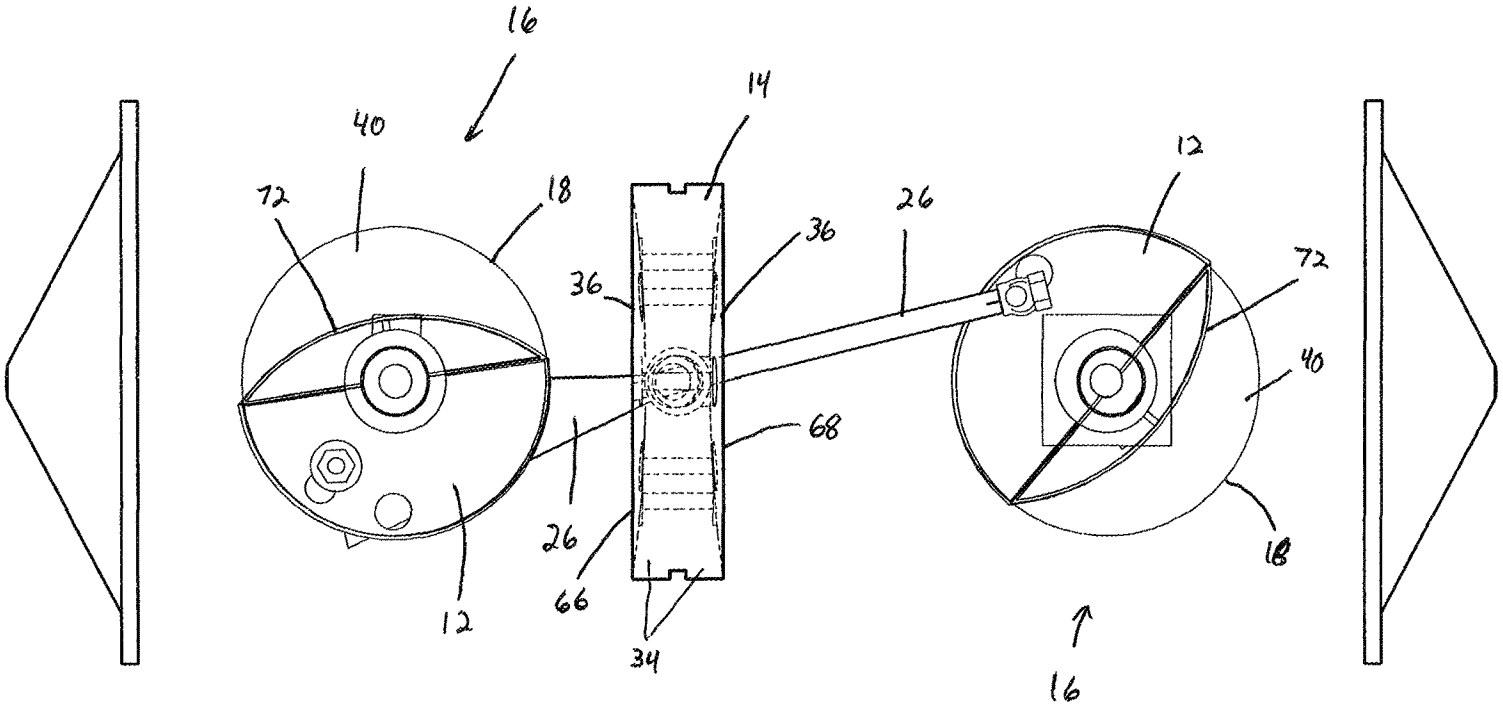
FIG. 11 is an end view of the piston, connecting rod, and crankshafts of the Stirling engine shown in FIG. 2.
Figure 12:
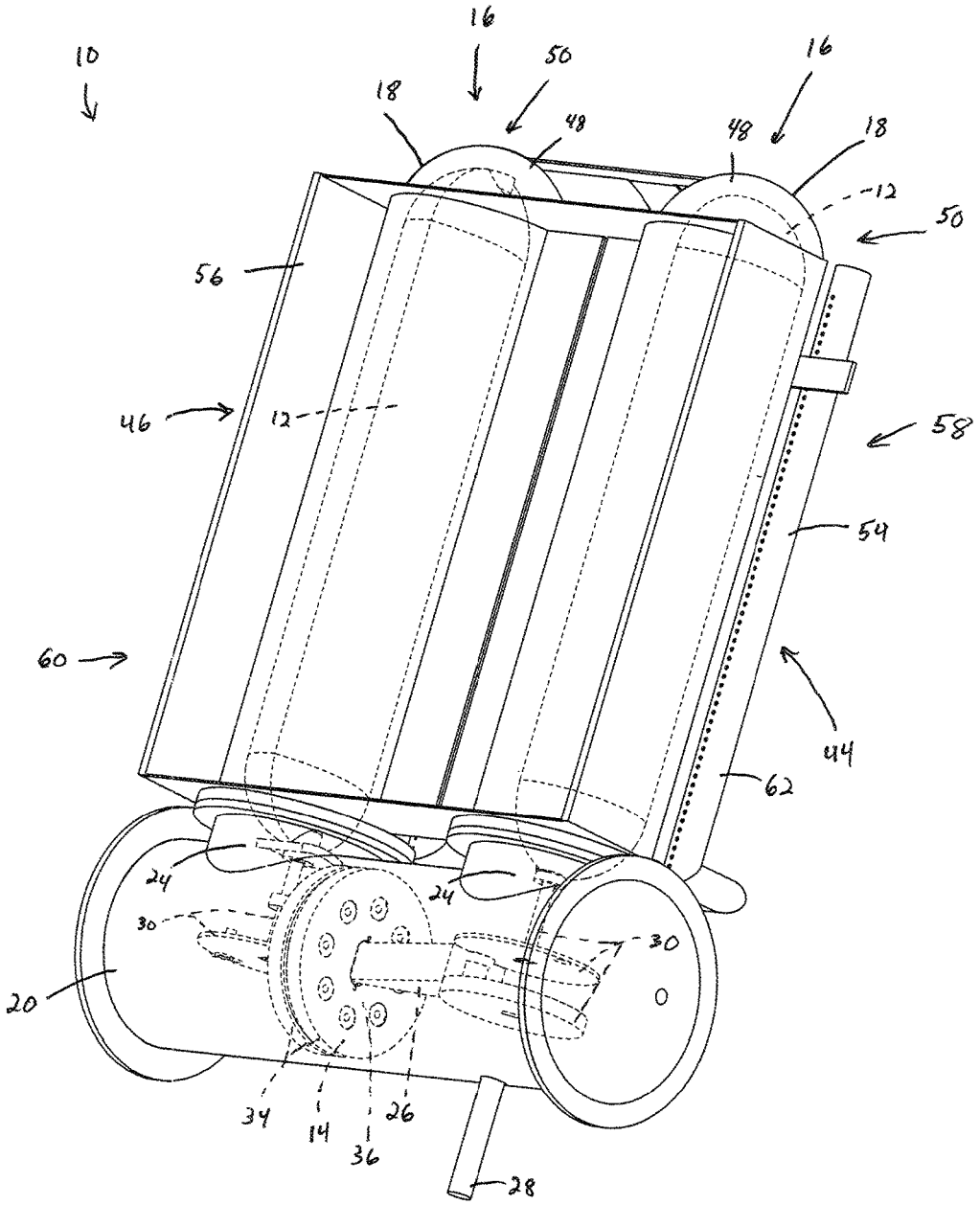
FIG. 12 is a hidden line perspective top view of the Stirling engine shown in FIG. 1 having a radiator coupled to the displacer housings and a heat source positioned underneath the displacer housings.
Figure 13:
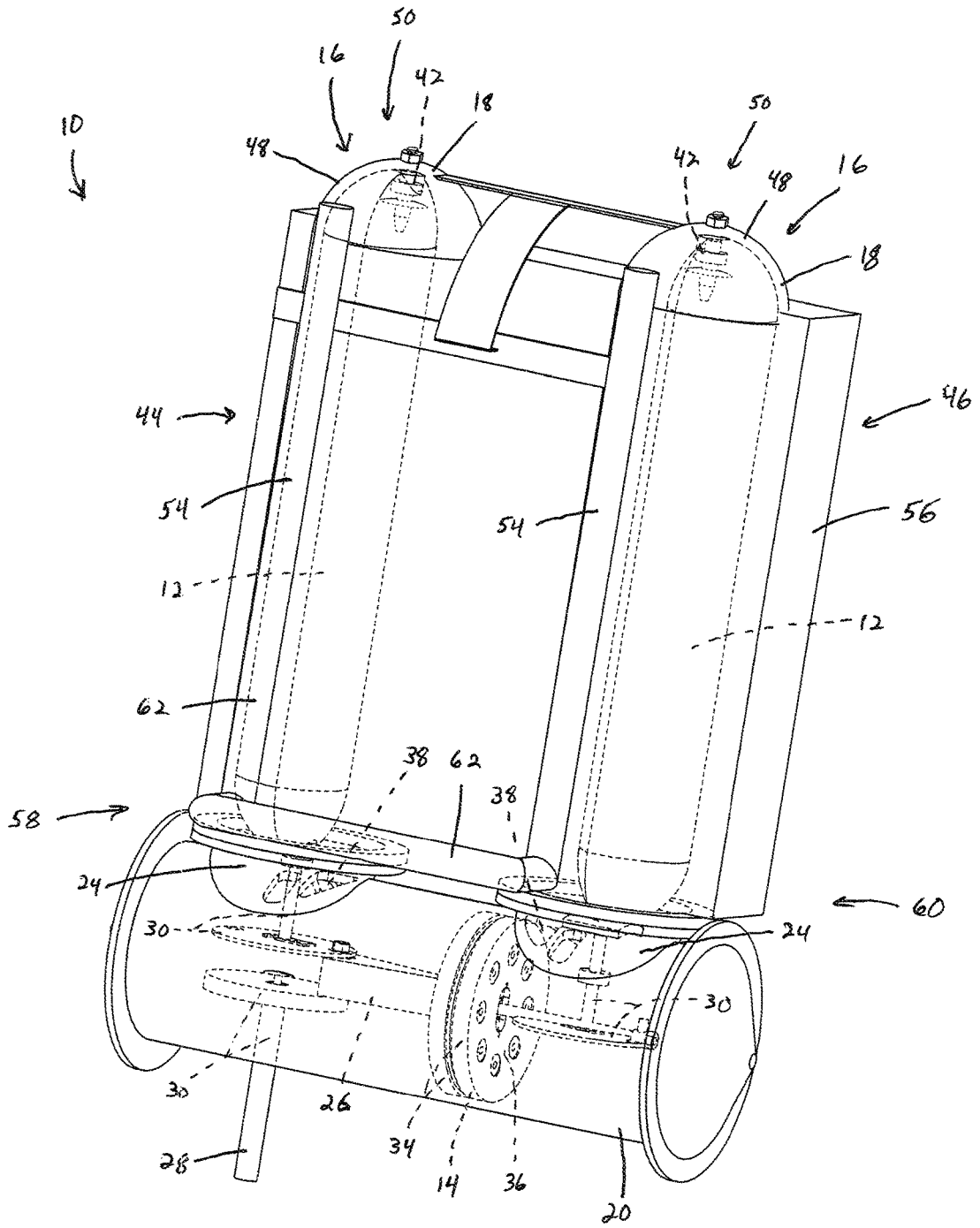
FIG. 13 is a hidden line perspective bottom view of the Stirling engine shown in FIG. 1 having a radiator coupled to the displacer housings and a heat source positioned underneath the displacer housings.
Figure 14:
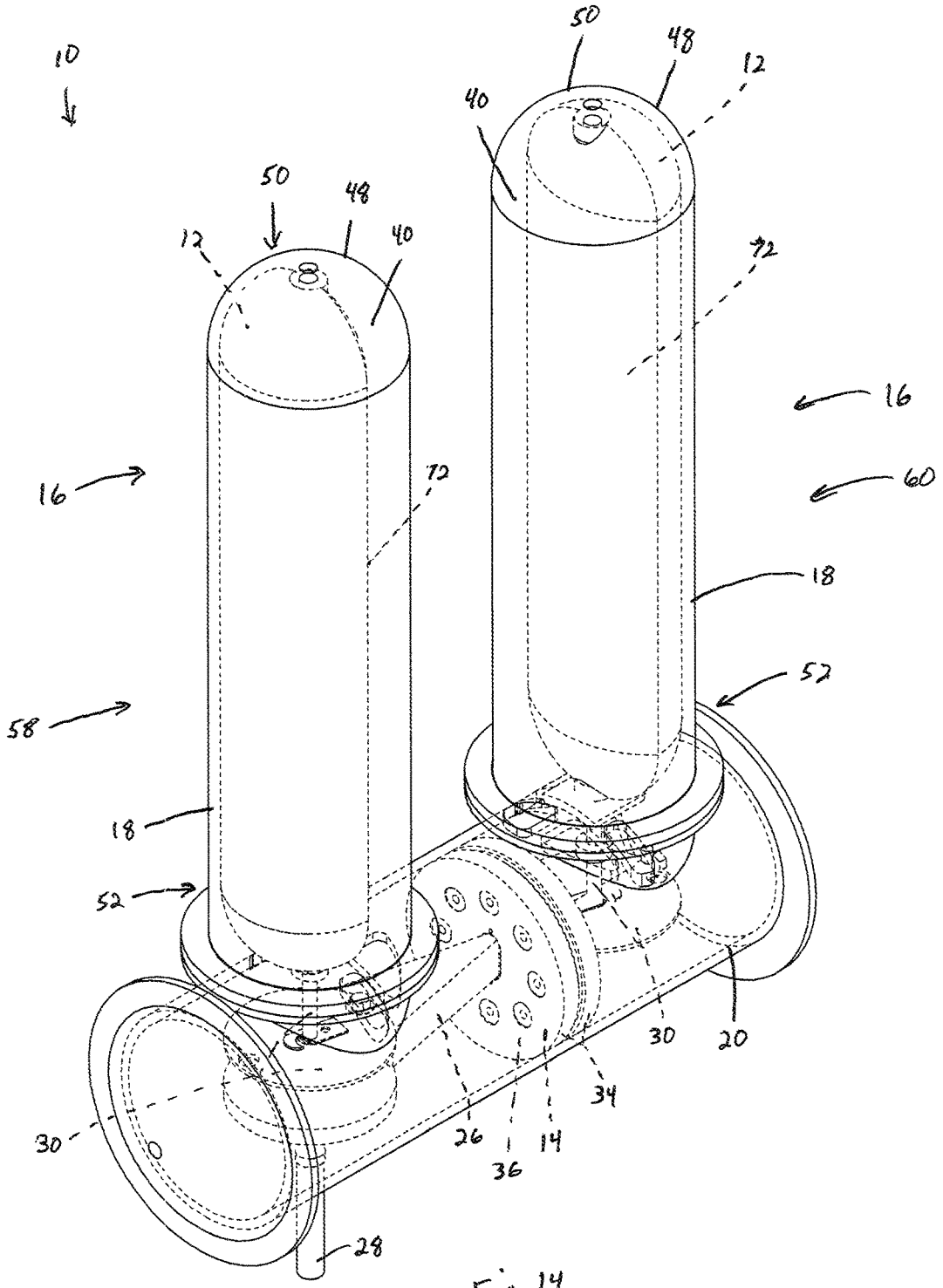
FIG. 14 is a hidden line perspective end view of the Stirling engine shown in FIG. 1.
Figure 15:
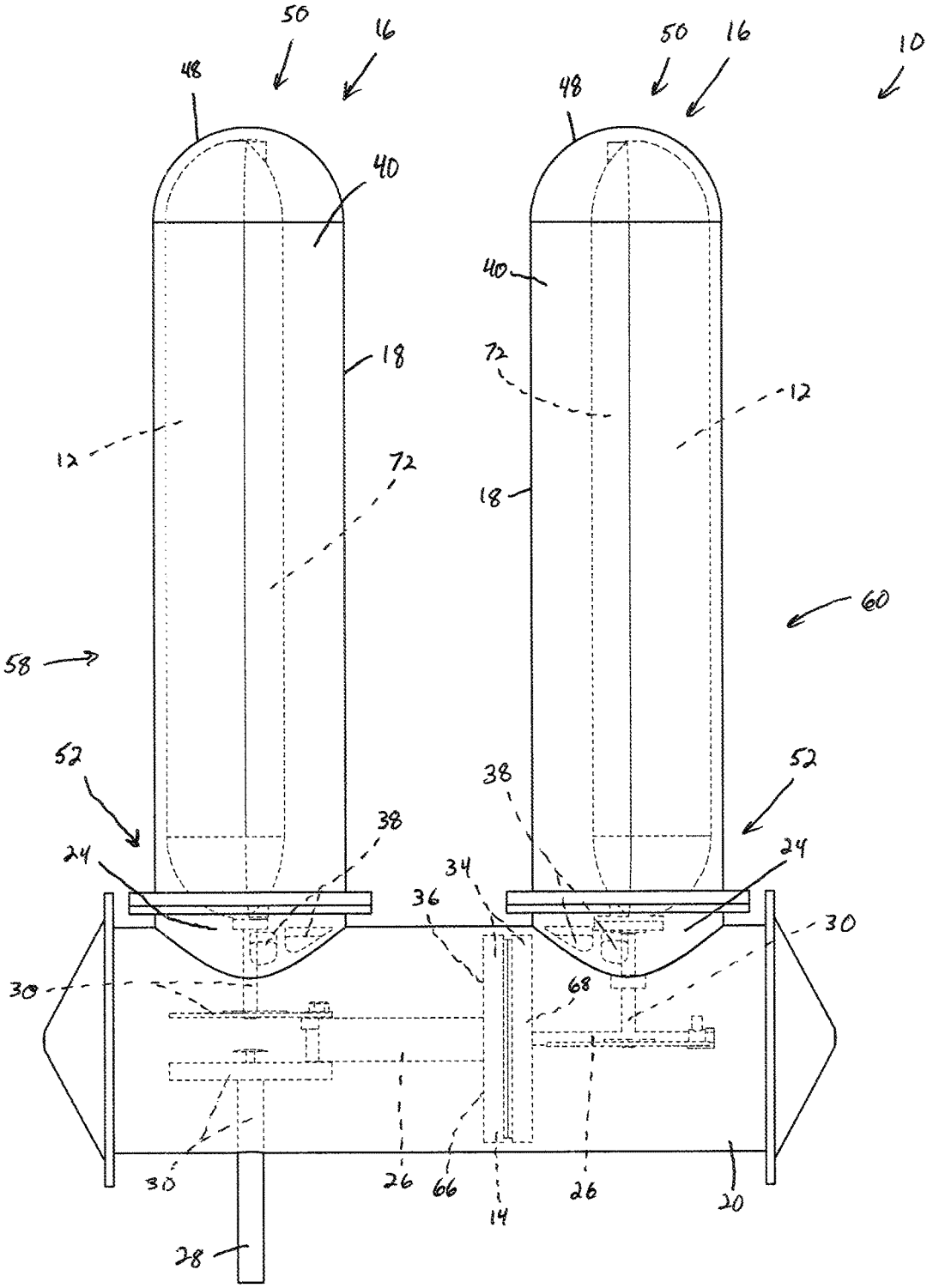
FIG. 15 is a hidden line perspective bottom view of the Stirling engine shown in FIG. 1.
Figure 16:
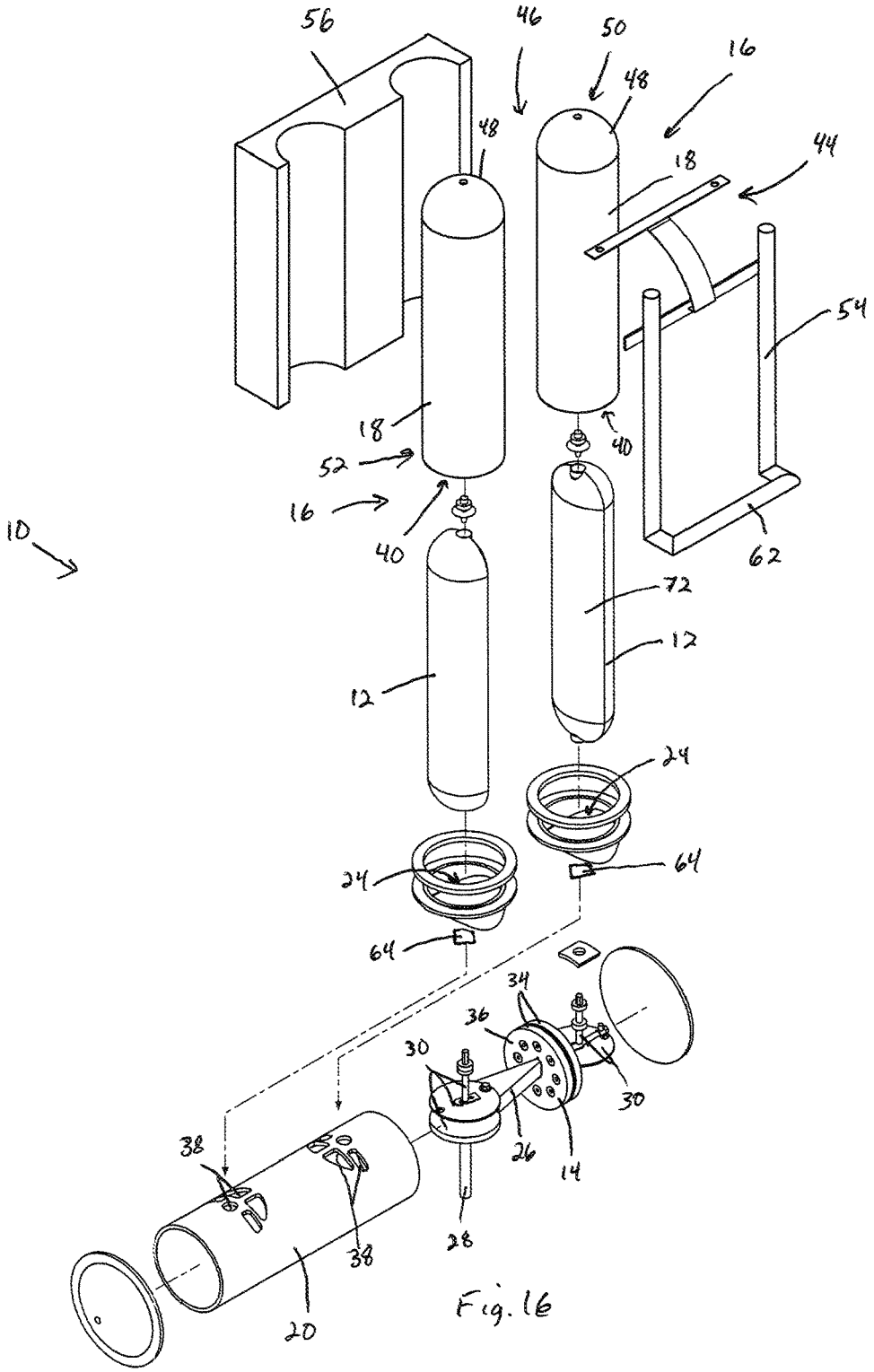
FIG. 16 is an exploded perspective view of the Stirling engine shown in FIG. 13.
Figure 17:
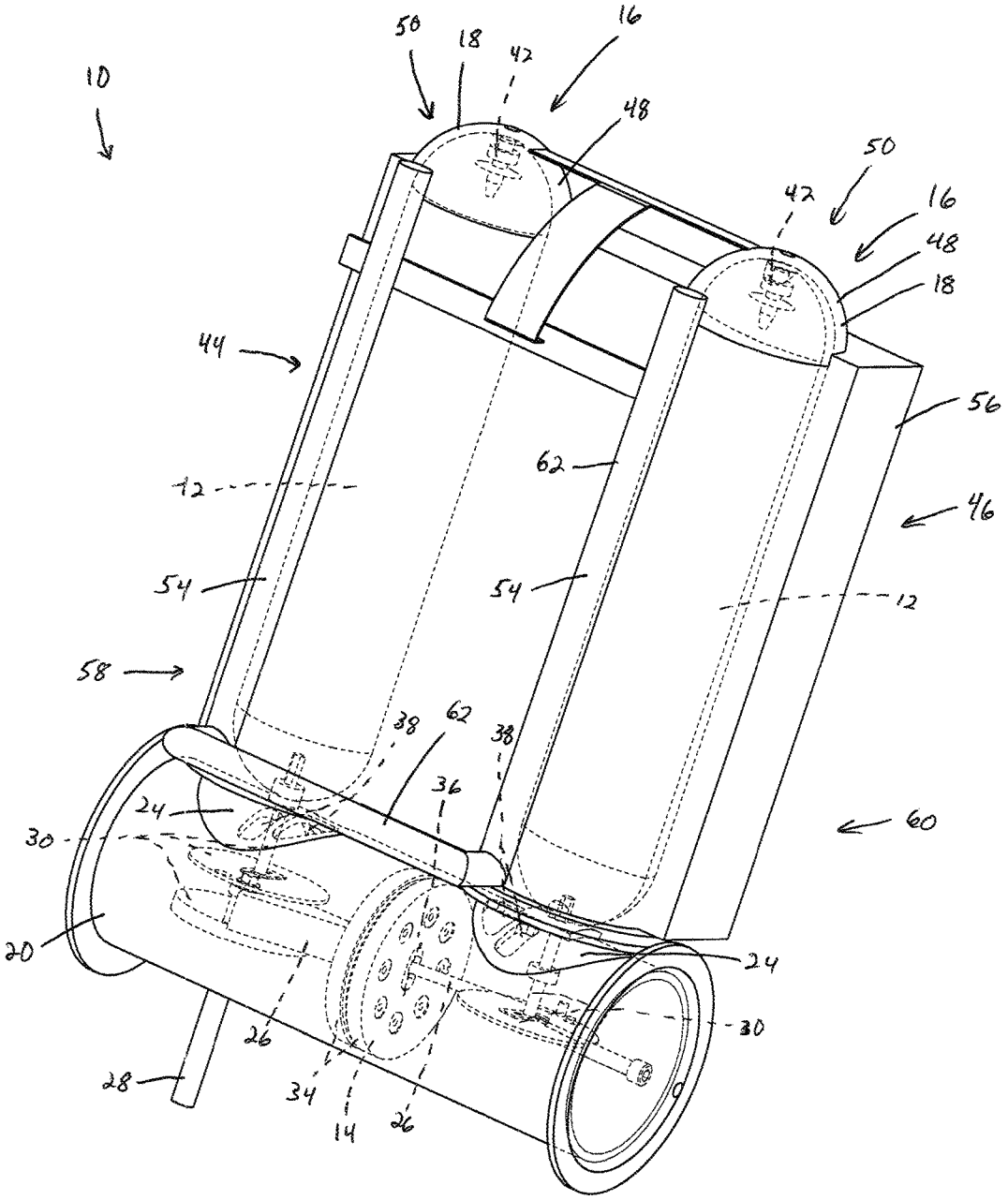
FIG. 17 is a hidden line perspective bottom view of the Stirling engine shown in FIG. 2 having a radiator coupled to the displacer housings and a heat source positioned underneath the displacer housings. The displacers and piston are shown in a different position compared to FIG. 13.
Figure 18:
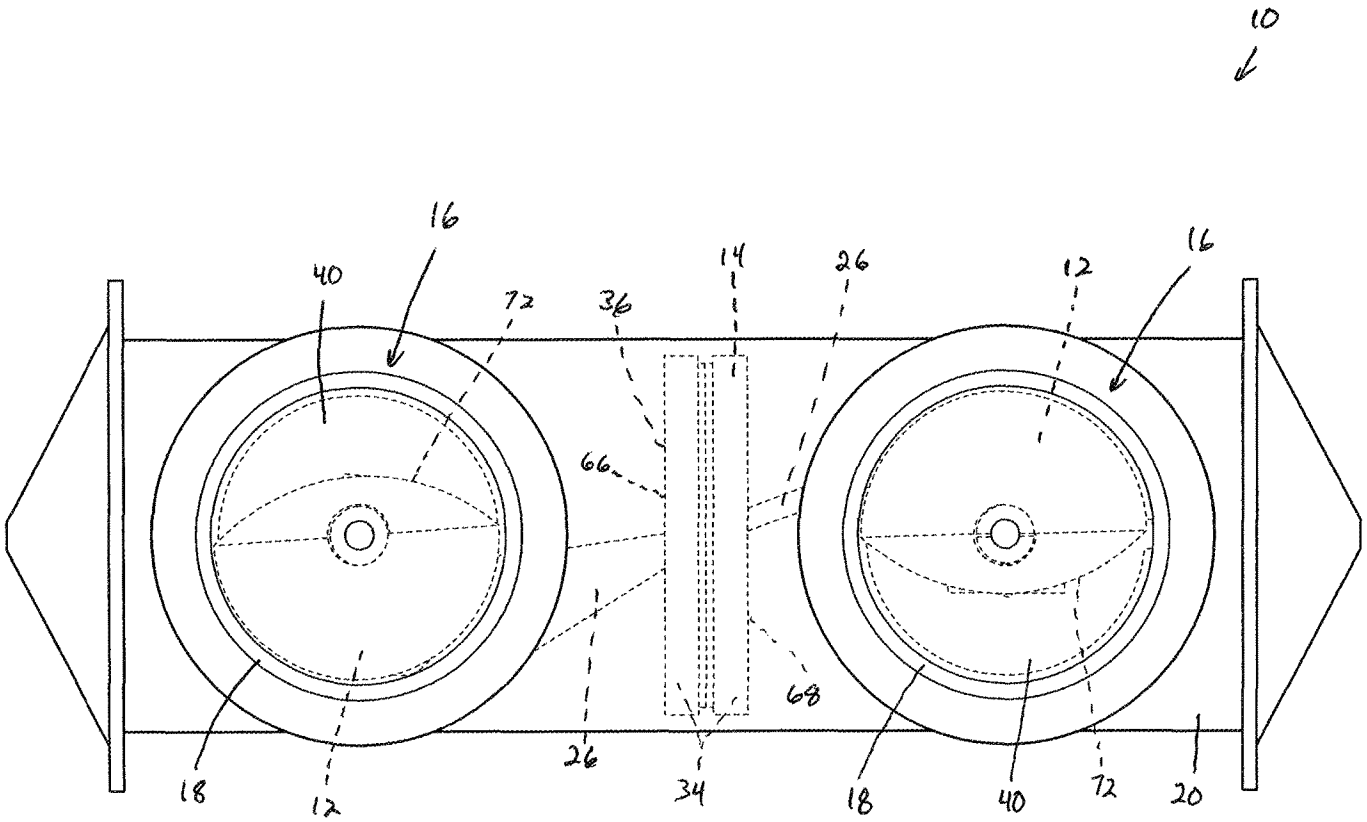
FIG. 18 is a hidden line end view of the Stirling engine shown in FIG. 17.
Figure 19:
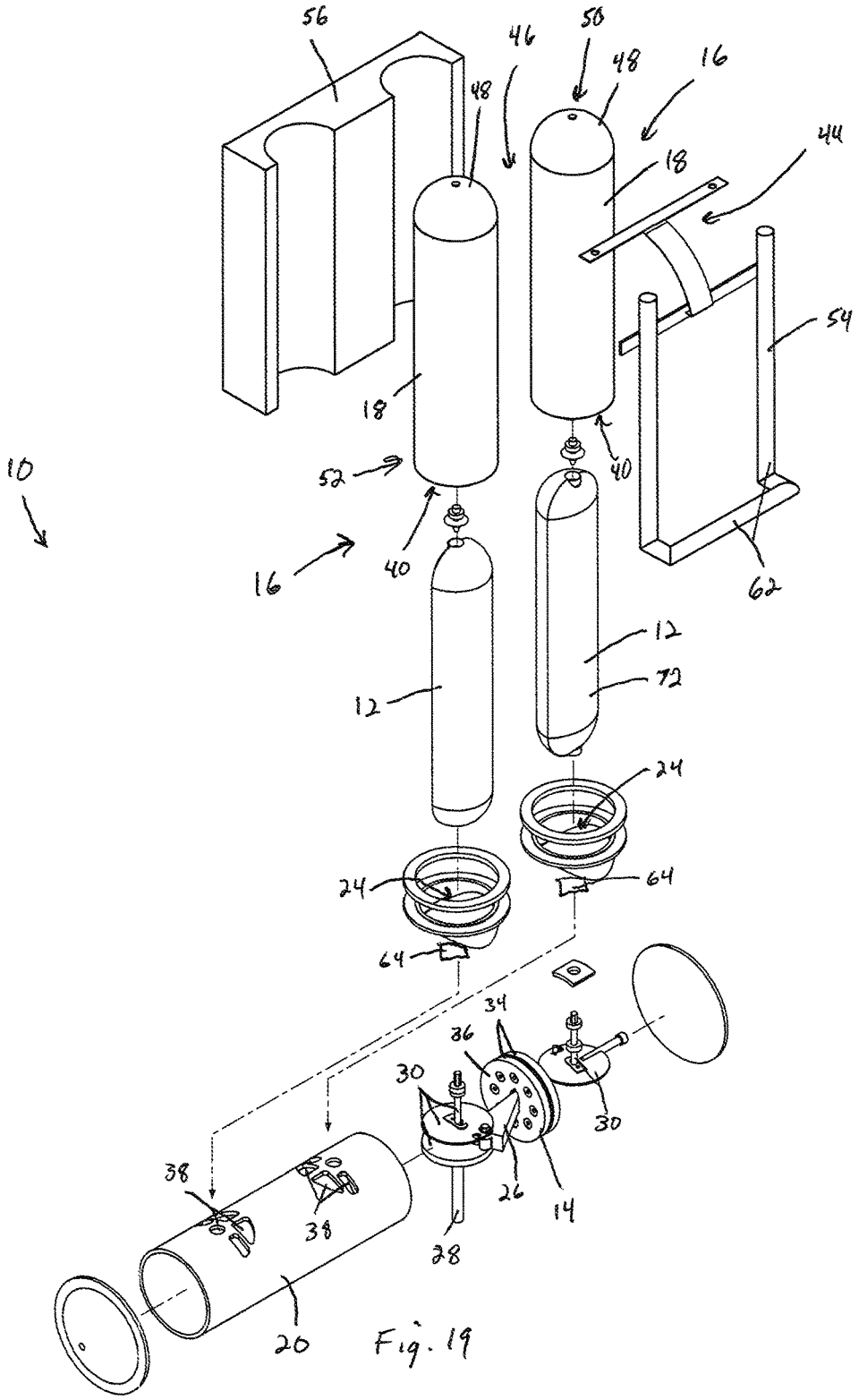
FIG. 19 is an exploded perspective view of the Stirling engine shown in FIG. 17.
Figure 20:
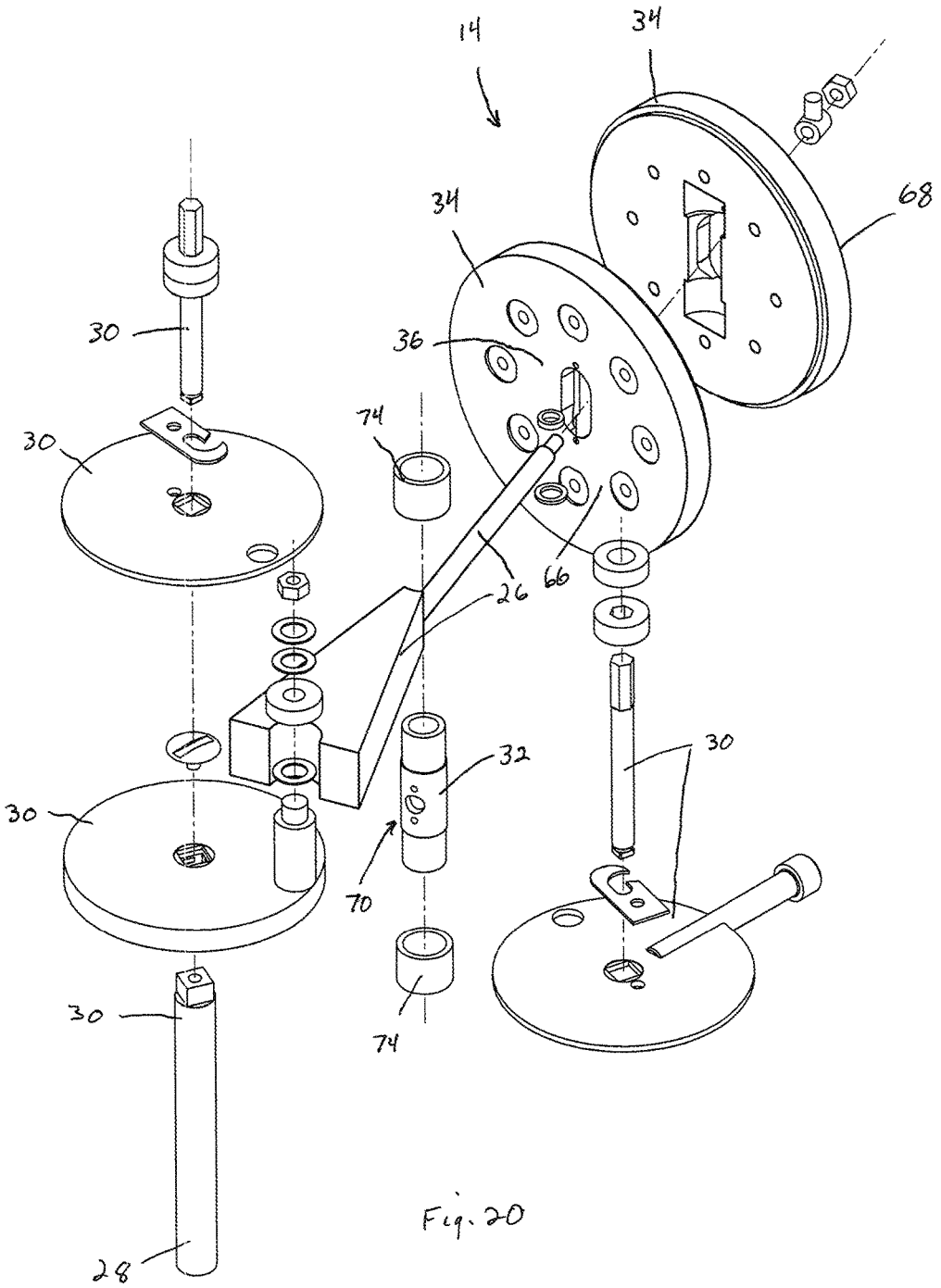
FIG. 20 is an exploded perspective view of the piston, connecting rods, and crankshafts in the Stirling engine shown in FIG. 17.

Provided herein is an improved Stirling engine 10, and methods of operation and use, that address the difficulties and maximizes the advantages of the Stirling cycle engine. Lower production and maintenance costs are possible due to the elimination of all but one internal seal (on the piston 14) sealing all moving parts within the pressure vessel (isolating them from heat and corrosive gasses or liquids) and fewer, simpler parts manufactured with less precision.

Greater power density is achieved by using two displacers 12 with one on either side of the piston 14 to produce power in each direction of every stroke similar to the Stanley steamer engine. Working gas is transferred at the end of the power stroke, similar to the Miller cycle engine, to prevent counter pressure, pre-load the coming power stroke, and simplify initial pressurization. Greater initial pressurization, possible due to the elimination of external seals, makes more gas molecules available to transfer heat.

Smoother quieter operation is achieved with a lighter flywheel by means of reshaping and rotating rather than reciprocating the displacer 12. Using a single piston 14 with both sides driven reduces complexity, compared to multiple cylinder engines of similar power output.

Rotating instead of reciprocating the displacer 12 eliminates the counter action of gas pressure on the displacer piston during the power stroke as well as the extra friction. The working gas is guided into a vortex that efficiently transfers heat between a wall of the heat exchanger 16 and the working gas. Adjusting the relative position of the displacer 12 and the piston 14 allows flexibility in where the heating and cooling areas are on the housing 18 of the heat exchanger 16.

Rotating at 90 degrees to the piston 14, unless connected through a constant velocity joint or powered by separate motor or timing belt, the displacer 12 provides precise control over the heating and cooling of the working gas. The displacer 12 may be formed of a lightweight, insulating, and heat resistant, inflexible compound of either graphite carbon or silicon. The displacer 12 may be coated with a pattern of insulator such as Aerogel and regenerator material (such as nickel foam) to appropriately guide heat flow and have a shape that creates and controls the turbulence of the working gas.

Working gas turbulence is controlled both by the cam shape of the displacer 12 which compresses and releases the working gas in the desired direction and place, and by the shape of the chamber 40 it creates as it directs the gas movement out of and into the piston cylinder 20. The working gas can be trapped in the displacer 12 for a few degrees and released suddenly by creating a rotating valve at the intersection of the displacer 12 and piston cylinder 20, for greater power. In an embodiment, a constantly rotating vortex is formed as the displacer 12 turns and the working gas expands and contracts. In another embodiment, further control of turbulence may be achieved by placing storage pockets in the displacer 12 that will pressurize during the heating cycle and release the pressure in a specific direction through a nozzle during the cooling cycle. The displacer 12 shape and relative motion creates a constant sized area in which a mechanical means of directing turbulence, such as a fan, can be inserted if desired.

Greater heat input and therefore power as well as reduced complexity is made possible through utilizing the entire length of the displacer housing 18 as opposed to heating only one end of the housing 18 as in current designs (a wider path allows more heat to flow). More efficient heat transfer is achieved by means of greater control of working gas turbulence, optimization of the displacer chamber 40 volume to surface ratio, shape, surface roughness and corrugation, direct control of heat transfer from heat source, adjustable displacer to piston ratio and minimization of dead space. The passage 24 between the displacer 12 and the piston 14 may be filled with a mesh of nickel foam that acts as a regenerator 64.

The use of a through-the-piston 14 connecting rod 26 creates accurately timed coordination and counter rotation of the opposing displacer 12. In addition to eliminating possible frozen states on startup, the counter rotation of the displacers 12, with the flywheel turning opposite the direction of the output shaft 28, reduces gyroscopic progression that may be an issue in some applications. In most applications putting the flywheel on the output shaft 28 will reduce total weight. Some configurations may disallow the use of a one piece through the piston 14 connecting rod 26 and require either two standard mirror image connecting rods or a timing belt or electronic means of coordinating the rotation of the two displacers 12. Since the displacers 12 regulate and time the heat transfer from the exchanger 16 to the working gas which then pushes on the piston 14, as long as the displacers 12 are coordinated, no mechanical connection is required between the piston 14 and displacers 12. A constant speed can be obtained by turning the displacers 12 electronically to control the piston 14 and crankshaft 30.

The piston 14 is designed as a two identical piece part that is bolted together and houses a piston pin 32 on bearings 74 and provides for easy assembly of two opposing continuous oil-less piston rings 34. The concave shape of the piston face 36 provides clearance for the crankshaft 30, strength for the power stroke and brings the displacers 12 closer together without additional mechanical parts. Controlled leakage at the extreme of the piston stroke, similar to the Miller cycle, eliminates counter pressure when pressure is left over from the power stoke.

The piston cylinder 20 doubles as the crankshaft housing and provides the fulcrum against which the crankshaft pushes. Since the entire engine 10 is a pressure vessel, containing it within standard tubing reduces weight and complexity. The openings 38 from the cylinder 20 to the displacer chamber 40 are shaped to minimize the loss of support against the pressure while providing adequate gas flow. Dead space is minimized by filling it with packing material to displace the gas. The bearing mounts 42 are the same distance apart as the length of the connecting rod 26, measured from bearing center to bearing center on the connecting rod 26 and the cylinder 20. Maintenance free bearings are located well away and shielded from heat sources for maximum maintenance free life. The lack of lubricating fluid eliminates the oil pump, tubing, machined channels oil filter and lightens the engine 10.

The displacer housing 18 functions as the heat exchanger. Essentially a long tube, strong enough to contain the pressure while heated on one side 44 and cooled on the other side 46. The displacer housing 18 has a welded cap 48 at one end 50 and is bolted or welded to the piston cylinder at the other end 52. While the points of assembly are shown in the figures as flanges, a high pressure model would use a stronger means of joining the pieces such as an interrupted thread design similar to a cannon breech, or a threaded pipe design or welding.

A rough finish and possibly corrugation interleaving with the displacer 12, to facilitate heat transfer, may be applied by chemical or mechanical means. When used with combustible fuels the heated side 44 can be coated with catalyst to maximize the chemical reaction of the fuel with the oxidizer. The ideal material would be pure carbon in crystal form with a nano-scale fractal pattern finish to facilitate heat transfer from the source through the wall and into the working gas. Less ideal but still functional materials would be titanium or commercial steel tubing. Greater efficiency can be gained by constructing the displacer housing 18 in a multi-part clam shell design separating the sides with insulation so the heat travels through the working gas instead of circumferentially through the shell. This may increase manufacturing costs; however, with the extended life span of the Stirling engine 10, the added efficiency of this option may be desired.

On the outside of the engine 10, the improvements include controlling and directing the heat from whatever source 54 directly to the desired area on the exchanger 16 with no need of the commonly used heater assembly. The use of insulation and ducting would be tailored to the heat source 54. The heat source 54 may be geothermal, solar, combustion, or other desired heat source. The radiator 56, if used in home or business power generation may double as a water heater. The supporting structure of the engine 10 and intake and exhaust would simplify the stacking and use of multiple engines 10 to achieve higher required output. Waste heat from the radiator 56 and the combustion products can partially be recycled to preheat air when combustible fuels are used. When using combustible fuels, the combustion area can be optimized for maximum efficiency depending upon the fuel used. Materials are chosen to optimize recycling of engines 10 after their useful life. Maintenance is simplified with standard fasteners and bearings that are widely available. Standard tubing sizes and common piston sizes are purposely chosen, to simplify any repairs that may be needed in rural areas as well as reduce production costs. The entire engine 10 is considered to be a pressure vessel, but the extra weight is minimal considering the greater power density achieved, that all moving parts are safely hidden inside and protected from dust and moisture, and the elimination of all but one external dynamic seal around the output shaft 28.

In an embodiment one side 58 of the engine 10 is powered and the other side 60 is used as a heat pump for refrigeration or heating. While shown parallel and equal in the figures, the displacer tubes 18 are independent of each other and multiple configurations are possible. For example, one heat exchanger 16 could sit on the top of an insulated container and draw heat out of it forming a refrigerator. The heat would then be used to preheat the combustion process for the other heat exchanger 16 which would drive the system. Alternatively, one engine 10 could use fuel to drive a second engine 10 that was used as a heat pump to provide refrigeration of food or medicine or distillation of liquids such as drinking water. Distillation would use both the heated and cooled sides of either or both of the exchangers 16.

In the event of catastrophic failure due to external insult or internal defect, the high-pressure gas is released in a controlled manner by the use of materials that deform rather than break. The route of pressure relief at the end of piston 14 travel clears the working gas from the undamaged side of the engine 10 in a controlled manner. The radiator 56 also functions as a shrapnel catcher on the top while shrapnel directed downward is slowed by the heating duct work 62 and directed by installation design into the earth or a component of the installation and away from sensitive areas. If hydrogen is used as the working gas, mixing it with nitrogen or carbon dioxide should moderate the tendency to burn rapidly.

Also, contemplated herein are methods for providing rotational power according to the present disclosure. The methods thus encompass the steps inherent in the above described mechanical structures and operation thereof. Broadly, one method could include heating a volume of working gas with a heat source 54, directing the heated working gas to act on a piston 14, and rotating at least one displacer 12 to displace the working gas away from the heat source 54 such that the volume of working gas may be cooled.

Accordingly, the improved Stirling engine 10 has been described with some degree of particularity directed to the exemplary embodiments. It should be appreciated, though, that modifications or changes may be made to the exemplary embodiments without departing from the inventive concepts contained herein.

Illustrative Embodiments

In one embodiment, a double acting Stirling engine 10 in which a working fluid exerts force against a reciprocating piston 14 comprises: an elongated cylindrical heat exchanger 16 connected at a right angle, through regenerator material 64, to the piston cylinder 20 with an elongated rotating displacer 12, of such mass as to serve as a flywheel, inside the heat exchanger 16, coordinated with the piston 14, that moves the working fluid from the heat input side 44, at which time the working fluid expands and exerts an increase of force on the piston 14, to the heat extraction side 46, where the working fluid contracts and reduces the pressure exerted upon the piston 14, thus completing one cycle while a similar though not necessarily identical heat exchanger 16 and displacer 12 perform the same sequence against the second side 68 of the piston 14 180 degrees out of phase such that each direction of the piston 14 is productive with said parts arranged according to FIG. 1.

A valve 70 can be actuated by the angle of the piston rod 26 allowing the working fluid pressure to equalize across the piston 14 at the extremes of the stroke of the piston 14. The device 10 can include only one displacer 12 and heat exchanger 16 and the engine 10 is single acting. The displacer 12 can be comprised of one half lengthwise of one cylinder and a smaller division of a second cylinder of a larger radius divided along its length on a chord of length less than or equal to the diameter of the first half cylinder such that when the displacer 12 is mounted in its heat exchanger 16 there exists a gap for the working fluid to fill of the desired moon shape on one half of the radius of the displacer 12 between the displacer 12 and the wall of the heat exchanger 16 for the working length of the displacer 12.

The displacer 12 can comprise one half lengthwise of a cylinder and a separate cylinder of larger diameter divided lengthwise along a chord in which the chord of the larger cylinder is less than or equal to the diameter of the first smaller cylinder diameter. The displacer 12 can be cylindrical and the working surface 72 can be along the length of the cylinder and the shape of the end closest to the piston 14 directs the flow of working fluid in a desired manner. The displacer 12 can be cylindrical and the working surface 72 can be along the length of the cylinder and the shape of the end closest to the piston 14 directs the flow of working fluid in manner supportive of the desired working fluid flow within the heat exchanger 16.

The displacer 12 can be cylindrical and regenerator material 64 can be attached to the displacer 12. The displacer 12 can be cylindrical and a tube with regenerator material 64 can extend along the length of the displacer 12. The displacer 12 can be cylindrical and attached to the displacer 12 in the gap are various fins and equipment for monitoring and directing fluid flow. The displacer 12 can be cylindrical and a fan blade can extend along the length of the displacer 12 for purpose of directing working fluid flow.

The displacer 12 can be cylindrical and its rotation can be controlled by being mechanically attached to the crankshaft 30 for the piston 14. The displacer 12 can be cylindrical and its rotation ca be controlled by external timing device or motor. The displacer 12 can be cylindrical and its rotation can be controlled by magnetic coupling to a timing device. The displacer 12 can be cylindrical and can be composed partially or wholly of an insulating material. The displacer 12 can be cylindrical and can be a sealed vessel.

The Stirling engine 10 can include two displacers 12 and two heat exchangers 16 each coordinated with opposite sides of the piston 14. The two displacers 12 and two heat exchangers 16 can each be coordinated with opposite sides 66, 68 of the piston 14 by means of a connecting rod 26 that extends through the piston 14 and forces counter rotation of each displacer 12. The two displacers 12 and two heat exchangers 16 can each be coordinated with opposite sides 66, 68 of the piston 14 by means of two connecting rods 26 each attached to opposite sides 66, 68 of the piston 14 which allow coordinated yet same or opposite rotation of the displacers 12.

The connecting rod 26 can mount within 1 inch of the center of the height of the piston 14. The connecting rod 26 can be sealed at its connection to the piston 14 so as to not allow transfer of the working fluid during the active phase of the stroke. The connecting rod 26 can extend through a piston pin 32 which is mounted in the piston 14.

A strategically placed hole in the piston pin 32 can be used as a valve 70 to allow transfer of the working fluid at the extremes of the piston stroke by means of channels cut in the piston 14 and the pin 32 that align at the extremes of the piston stroke. The Stirling engine 10 can include a means allowing transfer of the working fluid from one side of the piston 14 to the other only at the extremes of the piston stroke. The Stirling engine 10 can be configured with one side 58 converting heat differential, as from a heat source 54, into mechanical motion then used to power the other side 60 used for converting mechanical motion into heat differential as might be used in refrigeration or distillation.

The piston cylinder 20 can encompass part of the crankshaft 30. The piston cylinder 20 can serve as support for the output shaft 28. The displacer(s) 12 can be mounted at a right angle to the piston cylinder 20. Regenerator material 64 can be located between the displacer 12 and the piston 14. The displacers 12 and displacer housings 18 can be parallel to each other and can be mounted on the same side of the piston cylinder 20. The displacers 12 and displacer housings 18 can be parallel to each other and mounted on opposite sides of the piston cylinder 20. The displacers 12 can also not be mounted parallel to each other.

The heat dissipating radiator 56 can function as a shrapnel catcher in the event of catastrophic failure of the pressurized heat exchanger 16. The device 10 can provide power for electrical generation. The device 10 can provide power for use in an automobile. The device 10 can provide useable mechanical power. The device 10 can be used on an aircraft. The device 10 can be used in a structure or dwelling. The device 10 can be used to convert sunlight to electricity. The device 10 can be used to convert fuel into electricity. The device 10 can be used on watercraft of any kind. The device 10 can be used on a spacecraft.

The piston 14 can comprise two identical discs 34 fastened together. The device 10 can be attached to an alternator or generator which serves as a starter. The device 10 can be attached to an alternator or generator and the alternator or generator can be in a pressurized container obviating the need for a seal on the output shaft 28. The device 10 can include a flywheel within the pressurized area. The device 10 can include a flywheel placed on the output shaft 28.

What I claim as my invention is:

1. A Stirling engine comprising:

a cylinder filled with working fluid;

a piston positioned in the cylinder and reciprocating along a piston stroke, the piston including a first side facing one direction in the cylinder and a second side facing an opposite direction in the cylinder;

a heat exchanger coupled to the cylinder, the heat exchanger including an elongated rotating displacer that moves working fluid between a heat input side of the heat exchanger and a heat extraction side of the heat exchanger; and a valve positioned between the first side of the piston and the second side of the piston;

wherein the valve opens when the piston is at or near an end of the piston stroke and provides fluid communication between working fluid on the first side of the piston and the second side of the piston;

wherein working fluid in the cylinder and the heat exchanger is permanently contained in the Stirling engine; and wherein the elongated rotating displacer is positioned perpendicular to the cylinder.

2. The Stirling engine of claim 1 comprising regenerator material positioned between the cylinder and the heat exchanger.

3. The Stirling engine of claim 1 comprising a connecting rod coupled to the piston, wherein the valve is actuated when the connecting rod reaches a certain angle relative to the piston.

4. The Stirling engine of claim 1 comprising a heat source that supplies heat to the heat exchanger.

5. The Stirling engine of claim 1 comprising an output shaft extending through a wall of the cylinder.

6. The Stirling engine of claim 5 comprising a flywheel coupled to the output shaft.

7. The Stirling engine of claim 1 wherein the piston includes two identical discs coupled together.

8. A Stirling engine comprising:

a cylinder filled with working fluid;

a piston positioned in the cylinder and reciprocating along a piston stroke, the piston dividing the cylinder into a first section and a second section;

a first heat exchanger coupled to the first section of the cylinder, the first heat exchanger including a first displacer that moves working fluid between a heat input side of the first heat exchanger and a heat extraction side of the first heat exchanger;

a second heat exchanger coupled to the second section of the cylinder, the second heat exchanger including a second displacer that moves working fluid between a heat input side of the second heat exchanger and a heat extraction side of the second heat exchanger; and a valve that opens when the piston is at or near an end of the piston stroke to allow working fluid to pass between the first section of the cylinder and the second section of the cylinder;

wherein the first displacer and the second displacer rotate approximately 180 degrees out of phase with each other; and wherein the first displacer and the second displacer are positioned perpendicular to the cylinder.

9. The Stirling engine of claim 8 comprising regenerator material positioned between the cylinder and the first heat exchanger and the cylinder and the second heat exchanger.

10. The Stirling engine of claim 8 comprising one or more heat sources supplying heat to the heat input side of the first heat exchanger and the heat input side of the second heat exchanger.

11. The Stirling engine of claim 8 comprising an output shaft extending through a wall of the cylinder.

12. The Stirling engine of claim 11 comprising a flywheel coupled to the output shaft.

13. The Stirling engine of claim 8 comprising a connecting rod coupled to the piston, wherein the valve is actuated when the connecting rod reaches a certain angle relative to the piston.

14. The Stirling engine of claim 8 wherein rotation of the first displacer and the second displacer is controlled by one or more connecting rods coupled to the piston.

15. The Stirling engine of claim 8 wherein the piston includes two identical discs coupled together.

16. The Stirling engine of claim 8 wherein working fluid in the cylinder, the first heat exchanger, and the second heat exchanger is permanently contained in the Stirling engine.

17. The Stirling engine of claim 8 wherein the first displacer and the second displacer are parallel to each other and positioned on the same side of the cylinder.

18. A method for operating a Stirling engine comprising:

reciprocating a piston in a cylinder filled with working fluid, the piston including a first side facing one direction in the cylinder and a second side facing an opposite direction in the cylinder, the Stirling engine including a heat exchanger coupled to the cylinder, the heat exchanger including a heat input side, a heat extraction side, and an elongated displacer positioned perpendicular to the cylinder;

rotating the elongated displacer to move working fluid between the heat input side of the heat exchanger and the heat extraction side of the heat exchanger; and opening a valve when the piston is at or near an end of the piston's reciprocal motion to provide fluid communication between working fluid on the first side of the piston and the second side of the piston;

wherein the working fluid in the cylinder and the heat exchanger is permanently contained in the Stirling engine.

19. The method of claim 18 comprising opening the valve when a connecting rod coupled to the piston reaches a certain angle relative to the piston.

20. The method of claim 18 comprising supplying heat to the heat input side of the heat exchanger.

21. The method of claim 18 wherein the heat exchanger is a first heat exchanger, the elongated displacer is a first elongated displacer, and the Stirling engine comprises a second heat exchanger including a heat input side, a heat extraction side, and a second elongated displacer positioned perpendicular to the cylinder, and wherein the method comprises rotating the second elongated displacer to move working fluid between the heat input side of the second heat exchanger and the heat extraction side of the second heat exchanger.

* * * * *